United States Patent [19]

Porter

[11] 4,178,224

[45] Dec. 11, 1979

[54] APPARATUS FOR GENERATION AND CONTROL OF DOPANT AND REACTIVE GASES

[75] Inventor: Vernon R. Porter, Plano, Tex.

[73] Assignee: Texas Instruments Incorporated, Dallas, Tex.

[21] Appl. No.: 870,912

[22] Filed: Jan. 19, 1978

[51] Int. Cl.[2] ..... C25B 9/00; C25B 15/08

[52] U.S. Cl. ..... 204/237; 204/260; 204/266

[58] Field of Search ..... 204/260, 266, 265, 237, 204/101, 73

[56] References Cited

U.S. PATENT DOCUMENTS

| | | | |
|---|---|---|---|
| 1,375,819 | 4/1921 | Blumenberg, Jr. | 204/101 |
| 1,485,706 | 3/1924 | Plauson | 204/237 X |
| 2,193,323 | 3/1940 | Nitzschke et al. | 204/260 X |
| 2,228,264 | 1/1921 | Freedley | 204/260 X |
| 3,330,755 | 7/1967 | Mahany | 204/266 X |

*Primary Examiner*—John H. Mack
*Assistant Examiner*—D. R. Valentine
*Attorney, Agent, or Firm*—James T. Comfort; Rene' E. Grossman; Gary C. Honeycutt

[57] ABSTRACT

A system for supplying arsine having automatic arsine monitoring and controls to a semiconductor reactor is described wherein arsine is electrochemically generated from an electrolyte solution such as an inorganic acid and an arsenite salt. The electrolytic cell vessel also comprises the cathode structure. A circular concentric barrier is provided to isolate the oxygen produced at the cathode in an annular region from the arsine generated at the anode located centrally within the cell.

10 Claims, 2 Drawing Figures

APPARATUS FOR GENERATION AND CONTROL OF DOPANT AND REACTIVE GASES

BACKGROUND OF THE INVENTION

This invention relates to a method and apparatus for the electrolytic generation of arsine having automatic arsine monitoring and controls to a semiconductor furnace or reactor.

The use of gaseous hydrides in the semiconductor industry has been important from the days of germanium to the present manufacture of Group III–IV devices. Of the hydrides, arsine has been prominent because of its usefullness and its toxicity. Arsine is used as a convenient source for arsenic as a dopant for silicon and for the epitaxial growth of GaAsP. Because of this toxicity with a TLV of 0.05 PPM, the concentration is compressed gas cylinders with hydrogen is kept below 15 percent. The handling facilities, safety equipment, and peripheral instruments necessary to adequately monitor, store, and use this gas are complicated and expensive. Since arsine is almost always used at the input of a reactor whose run time is limited, it would be highly desirable to have a source of arsine that could be easily turned off as from an in-situ cell generator where only the required amount of arsine gas would be generated upon demand, thus eliminating the storage of highly pressurized cylinders of poisonous arsine gas.

U.S. Pat. No. 1,375,819, issued Apr. 26, 1921 to Henry Blumenberg, Jr., discloses a method for the preparation of arsine by the electrolysis of a salt or oxide of arsenic in the presence of sulphuric acid and potasium sulphate or other compounds capable of liberating nascent hydrogen upon electrolysis. However, the process as described fails to provide a sufficient concentration of arsine required by present day semiconductor processing in addition to failing to separate the generated oxygen from the generated arsine within the cell thereby giving separate sources for each.

Accordingly, an object of the present invention is to provide a method for the electrochemical generation of arsine in a self-contained electrolytic cell.

Yet another object of the present invention is to provide an electrochemical generator system for supplying arsine to a semiconductor reactor or furnace have automatic arsine monitoring and controls therewith.

Another object of the present invention is to provide a method for the production of arsine that can be easily regulated and turned off as required.

Still another object of the present invention is to provide separate sources for oxygen and arsine from an electrochemical generator.

It is still yet another object of the present invention to provide a method for generating of arsine a gas concentration of about 20–38 percent arsine.

SUMMARY OF THE INVENTION

A method and apparatus for the generation and control of arsine facilitating "turn-off" of the gas sources is disclosed. The invention involves a self contained electrochemical cell requiring electricity and occasion recharging with chemicals so as to generate the arsine in-situ by electrolysis. For production of arsine the cell employs a strong inorganic acid such as phosphoric acid as a solvent for the solute such as sodium arsenite. A low voltage power supply provides the current between the electrodes of the cell for reducing the arsenite to arsine, with the amount of current being indicative of the amount of arsine being generated. By way of an example the anode comprises platinum on niobium and the cathode comprises high purity copper. This technique eliminates the use of pressurized gas cylinders of poisonous arsine employed in the processing of semiconductor materials with the related problems of safety, handling and storage thereof.

The electrolytic cell vessel also comprises the cathode structure. A circular concentric barrier is provided to isolate the oxygen produced at the cathode in an annular region from the arsine generated at the anode located centrally within the cell.

The arsine generator is connected to a semiconductor reactor or furnace for epitaxial growth or diffusion processing. The arsine concentration is automatically monitored at the inlet to the reactor and control signals are feed back to the generator for increasing or decreasing the arsine concentration.

BRIEF DESCRIPTION OF THE DRAWINGS

The invention, together with its various features and advantages, can be easily understood from the following, more detailed description, taken in conjunction with the accompanying drawings in which.

DETAILED DESCRIPTION

Figure 1:
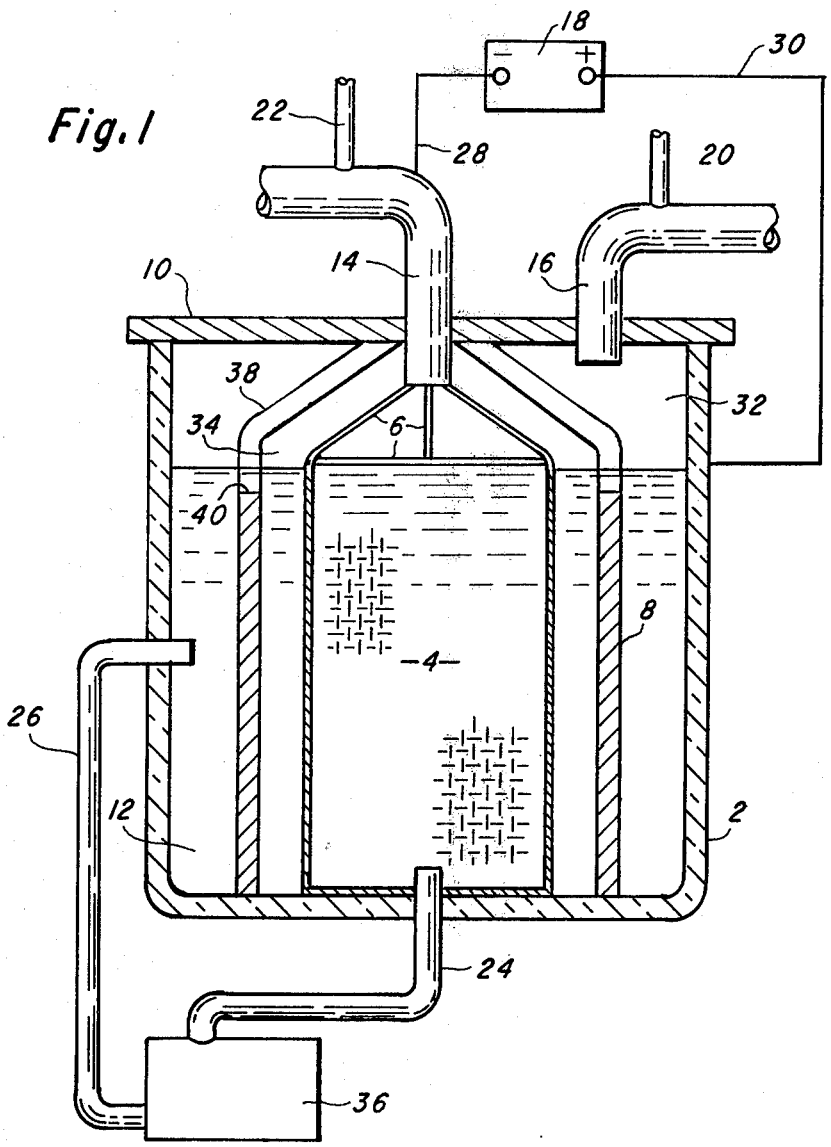
FIG. 1 is a schematic illustration of an electrochemical cell suitable for the generation of arsine.

Referring now to FIG. 1, the electrochemical generator comprises a plurality of concentric members. A cylindrical cell vessel or member 2 closed at one end is provided to contain the electrolyte solution 12 therein. In addition, cell vessel 2 also comprises the circular or tubular cathode of the cell. The major cathodic product of the electrolytic reduction of aqueous solutions is generally hydrogen. It is this hydrogen product that must be suppressed to favor the production of arsine. A choice of cathode materials were taken from those with high hydrogen over voltages. The cell vessel or cathode may be fabricated from material such as copper, silver, lead, tin, platinum, carbon, mercury, and graphite. For the production of high concentration of arsine gas, the cathode preferably comprises copper or silver and more preferably high purity copper.

When a current is passed between the electrodes, the arsenic ions in solution react with the copper surface when a copper cathode is used to form a copper arsenide layer. This layer it is believed acts as the material composition of the cathode during the generation of arsine.

The cell vessel has two ports, 24 and 26. These ports are used to provide fresh electrolyte to the cell for regeneration and to maintain a constant concentration of arsenic ions in solution. Port 24 is used to withdraw electrolyte solution from the cell and is fed to a regeneration system 36. Fresh electrolye solution is fed back to the cell by way of port 26. A description of the regeneration system is not described as it does not constitute part of the present invention. Any system which can provide a high concentration of arsenic (+3) ions in solution may be used with the method of the present invention.

Concentric with the cell vessel and surrounding the anode is a cylindrical first gas barrier 8. This structure is fabricated from Porex ® (porous polypro) whose major function is to act as a diaphragm to separate the gases in the bubble stage. This barrier may also be of solid non-corrosive material such as PVC where a gap is provided at the bottom of the cell for the transfer of $H^+$ions. There is some solubility of the gases in the liquid electrolyte; but this is relatively small. An additional second barrier 38 is provided in the gas region to isolate the anode and cathode gases in that region before passing through ports 14 and 16. It is not required that the solid barrier 38 be continuous with barrier 38. It is only required that it extend below the surface of the electrolyte. It may have a smaller or larger diameter than the barrier 8. This barrier must be solid so as to effectively isolate the gases. These two barriers may comprise one single barrier where the bottom portion is permeable and the upper portion impermeable or completely impermeable where a gap is provided at the bottom.

In another embodiment the barrier may comprise an ion exchange membrane where the arsenic ions would be contained within the annular region of the cell while a pure acid solution free of arsenic ions would be contained within the center region of the cell. The barriers 8 and 38 separate the cell into an annular region 32 and a central region 34. The annular region is used to contain the cathode generated products comprising arsine and hydrogen whereas the central region 34 is used to contain the anode generated produce oxygen. The barrier 8 can comprise any material that will be impermeable to the gases from the anode and cathode as well as having high ionic permeability for the arsenic ions and or $H^-$ in the electrolyte solution where a gap at the bottom of the cell is not provided. The cell is provided with a cover 10 to seal the open end of the vessel and having two ports 14 and 16. Port 16 is an exit port for passing arsine and hydrogen evolved at the cathode in the annular region 32. Port 14 provides for the passing of oxygen generated at the anode in the central section of the cell 34. As previously described these two ports are isolated from each other by means of barrier 38. In addition, port 14 is also used to support the anode which is suspended therefrom into the electrolyte solution in the center of the cell.

The major function of the anode is to liberate oxygen. Therefore, it should have a relatively low oxygen over voltage, but more importantly, it should not corrode or contaminate the electrolyte solution. Suitable anode materials comprise platinum or niobium, platinum on tantalum, platinum or titanium or any platinum group metal that will not oxidize. Pure platinum may be used at a somewhat high cost due to the amount of solid platinum required to fabricate the anode. It is preferred that the anode have a large surface area and therefore, a wire or mesh type structure is used. Such a structure is characteristic of an open geometry. Preferably the anode comprises platinum or niobium mesh or wire. The anode is connected to port 14 by means of platinum wire 6.

A power supply 18 is provided for passing current through the electrolye solution between the electrodes. The negative terminal is connected to the anode by means of wire 28 which is connected to port 14. The possitive terminal of the voltage supply is connected to the cathode by means of wire 30. The two most important electrical factors are the potential and the current density. These generally control the generated species and the quantity. The major consideration is to have enough voltage to overcome the cell resistance, polarization, etc., and still have enough current output to generate the volume of arsine require. Six volts and 12 amps have been found to generate arsine at 25% in a total gas rate of about 100 ml/min.

In choosing an appropriate electrolyte, four types were considered: acids, basic neutral aqueous solutions, and nonaqueous solvents. Acid electrolytes were found to be preferred for the production of arsine. Acids found suitable for production of arsine comprise phosphoric acid, sulfhuric acid, perchloric acid, arsenic acid, arseneous acid, in addition to other acids having stable oxy anions. Preferably phosphoric acid and sulfhuric acid is used and more preferably phosphoric acid.

The feed material or solute may be selected from compounds comprising arsenic trioxide, arsenic acid, arseneous acid, sodium arsenite, and other soluable arsenic salts or arsenite salts. Preferably arsenic trioxide and sodium arsenite is used and more preferably sodium arsenite. The arsenite is much more soluble than the oxide in any of the acids. The optimum electrolyte solution would contain a maximum concentration of As(+3) ions.

Due to the differential gas volume generation at the cathode and anode a pressure differential is realized between the annular section 32 and central section 34. This results in unequal liquid levels in the two sections of the cell. To balance the pressures and liquid levels gases are fed into the system through ports 20 and 22. By way of example, nitrogen or another inert gas is put into the anode section through port 22 and hydrogen or mixture with an inert gas is put into the cathode section through port 20.

Multiple cell units can be connected together in parallel or in series to increase the volume of arsine being generated. The output from the electrochemical generator is connected to a semiconductor furnace such as a vapor phase epitaxial reactor for production of compounds such as GaAs or a diffusion reactor for doping silicon material with arsenic. One such reactor is described in U.S. Pat. No. 4,048,955 assigned to the same assignee of the present patent application. In operation, the diffusion reactor uses a gas composition containing about 1% $AsH_3$ and the vapor phase reactor about 7% $AsH_3$. The output from the reactor can be diluted by increasing the quantity of hydrogen fed into the system through port 20. It is only required that the gas fed into the system through port 22 be increased to maintain balanced pressures within the cell.

Figure 2:
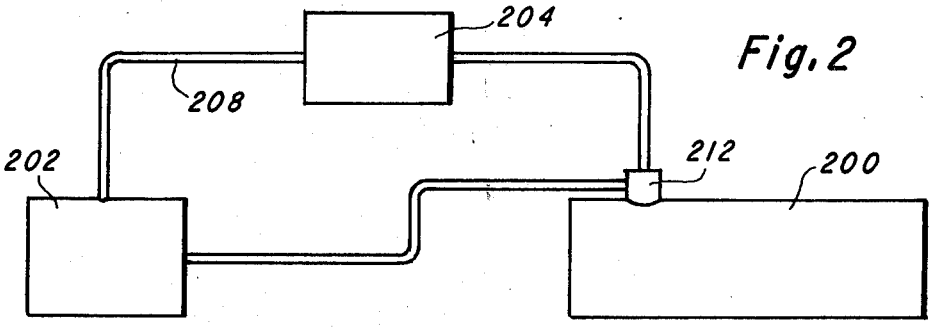
FIG. 2 is a schematic illustration of an arsine generation piped to a semiconductor furnace having automatic monitoring controls and feedback loop.

Referring now to FIG. 2, a semiconductor reactor 200 is illustrated being functionally connected to an electrochemical arsine generator 202 by means of supply line 210. In one embodiment, an automatic arsine gas monitoring system 204 is provided for determining the arsine concentration at the inlet port 212 to the furnace by means of line 206. The information is analyzed and an adjustment signal for increasing or decreasing the arsine concentration is sent by means of feedback line 208 to the generator 202. The arsine concentration can be changed by increasing or decreasing the volume of hydrogen being fed into the generator through port 20. Alternatively, the current supplied to the generator electrodes may be decreased while maintaining the same volume of hydrogen being fed into the system. This method however decreases the overall gas flow rate to the semiconductor reactor. Also, the arsine concentration may be changed by increasing or decreasing the As+ concentration in the generator by changing the electrolyte regeneration rate in regenerator 36 of FIG. 2.

The following examples are presented to define the invention more clearly without any intention of being limited thereby. The process described may also be used in cell designs other than that described by the figure. For example, the classical battery type cell or bell cell may be used.

EXAMPLE 1

A cell of design shown in the drawing was used to prepare arsine. The cathode was fabricated from high purity copper. A top cover plate and bottom plate was fabricated from PVC. The gas barrier in the electrolyte was Porex ® (porous polypro) being held together and sealed with thermoset plastic and the barrier above the electrolyte was fabricated from PVC. The anode was made from platinum on niobium expanded metal. In addition a bubble barrier of polyethelene mesh was employed over the electrolyte surface to break bubbles formed during the arsine generation.

The cell initially contained 7,500 milliliters de-ionized water, 375 milliliters of concentrated phosphoric acid and 197.5 grams of sodium arsenite. The current density at the cathode was 329 milliamps per inch square and 530 milliamps per inch square at the anode. At 60 amps, 150–180 milliliters per minute of oxygen was generated at the anode and 250 milliliters per minute of 20% arsine plus 80% hydrogen was generated at the cathode. The pressure in the cell was balanced using nitrogen in the anode section and hydrogen in the cathode section. The temperature of the cell was maintained between 25° and 45° C. using water as a cooling medium. The maximum arsine generated was 38 percent, and at a steady state condition, approximately 20%.

EXAMPLE 2

The procedure of Example 1, employing the cell in Example 1 is repeated with the exception that the sodium arsenite feed material is replaced with arsenic trioxide.

EXAMPLE 3

The procedure of Example 1, employing the cell in Example 1 is repeated with the exception that the copper cathode is replaced with a silver cathode. The interior of the copper vessel can be plated with silver instead of using a solid silver cell vessel as the cathode.

EXAMPLE 4

The procedure of Example 1, employing the cell in Example 1 is repeated with the exception that the sodium arsenite feed material is replaced with arseneous acid.

EXAMPLE 5

The procedure of Example 1–4, employing the cell of Examples 1–4 with the exception that phosphoric acid is replaced with sulfuric acid.

From the invention that has been described with respect to the specific and preferred embodiments thereof, many variations and modifications will immediately become apparent to those skilled in the art. It is therefore the intention that the appended claims being interpreted as broadly as possible in view of the prior art to include all such variations and modifications.

What is claimed is:

1. An electrochemical generator for the electrolytic generation of arsine comprising:
   - a cylindrical member open at one end thereof; said cylindrical member also comprising copper or silver as the cathode of said generator;
   - an anode comprising a platinum group metal suspended in the center of said cylindrical member;
   - a cylindrical barrier concentric with said cylindrical member and surrounding said anode, said cylindrical membrane separating said cylindrical member into an annular region and a central region, said cylindrical barrier having impermeability to the gases from said anode and said cathode;
   - a cover sealing said open end of said cylindrical member, said cover isolating said annular region from said center region;
   - a first port in said cover for passing gas from said annular region; and
   - a second port in said cover for passing gas from said center region.

2. A generator as set forth in claim 1 further including means for balancing the gas pressure in said annular region with the gas pressure in said center region.

3. A system for the electrolytic generation of arsine comprising:
   - a cylindrical copper member open at one end thereof, said member also comprising the copper cathode of said system;
   - means for contacting said cathode with an electrolyte solution comprising a mixture of an acid selected from a group consisting of sulfuric and phosphoric and a solute selected from a group consisting of sodium arsenite arseneous acid and arsenic trioxide;
   - an anode having an open geometry suspended in the center of said member; said anode selected from a group consisting of platinum metals that will not oxidize;
   - a cylindrical barrier concentric with said member and surrounding said anode, said barrier separating said member into an annular region and a center region, said barrier having ionic permeability for arsenic ions and/or $H^+$ ions and impermeability to the gases from said anode and said cathode;
   - a cover sealing said open end of said member, said cover isolating said annular region from said center region;
   - a first port in said cover for passing gas generated at said anode; and
   - a second port in said cover for passing gas generated at said cathode.

4. A system as set forth in claim 3 further including a regeneration system for providing fresh arsenic ions to said electrolyte solution.

5. A system as set forth in claim 3 further including means for supplying an inert gas in said center region and means for supplying hydrogen in said annular region for balancing the gas pressure therebetween.

6. A system for the electrolitic generation of arsine comprising:
   - an anode having an open geometry, said anode selected from a group consisting of platinum metals that will not oxidize;
   - a cylindrical gas barrier surrounding said anode, said barrier providing a center region;
   - a cylindrical copper cathode open at one end surrounding said barrier, said cathode providing an annular region between said cathode and said barrier;

means for containing an electrolyte solution within said cathode, said solution comprising a mixture of an acid selected from a group consisting of sulfuric acid and phosphoric acid and a solute selected from a group consisting of sodium arsenite arseneous acid and arsenic trioxide;

a cover sealing sealing said open end and isolating said annular region from said center region;

first means in said cover for passing gas from said center region; and second means in said cover for passing gas from said annular region.

7. A system as set forth in claim 6 further including means for supplying an inert gas in said center region and means for supplying hydrogen in said annular region for balancing the gas pressure therebetween.

8. A system for supplying arsine to a semiconductor reactor and control thereof, comprising:

an anode;

a cylindrical gas barrier surrounding said anode, said barrier providing a center region;

a cylindrical cathode open at one end surrounding said barrier, said cathode providing an annular region between said cathode and said barrier;

a cover sealing said open end and isolating said annular region from said center region, said cathode adapted to contain an electrolyte solution;

first means in said cover for passing gas from said center region; and second means in said cover for passing gas from said annular region, said gas comprising at least arsine;

means for functionally connecting said second means to said reactor at an inlet port, thereby providing a supply of arsine to said reactor;

means for determining the arsine concentration at said inlet port to said reactor; and means for providing an adjustment signal to be fed back to said system for increasing or decreasing the concentration of arsine at said inlet of said reactor.

9. A system for supplying arsine to a semiconductor reactor and control thereof, comprising:

a cylindrical copper member open at one end thereof, said member also comprising the copper cathode of said system;

said cathode adapted to contain an electrolyte solution comprising a mixture of an acid selected from a group consisting of sulfuric and phosphoric and a solute selected from a group consisting of sodium arsenite, arseneous acid and arsenic trioxide;

an anode having an open geometry suspended in the center of said member, said anode selected from a group consisting of platinum metals that will not oxidize;

a cylindrical barrier concentric with said member and surrounding said anode, said barrier separating said member into an annular region and a center region, said barrier having ionic permeability for arsenic ions and/or $H^+$ ions and impermeability to the gases from said anode and said cathode;

a cover sealing said open end of said member, said cover isolating said annular region from said center region;

a first port in said cover for passing gas generated at said anode;

a second port in said cover for passing gas generated at said cathode;

means for functionally connecting said first port to said reactor at an inlet port, thereby providing a supply of arsine to said reactor;

means for determining the arsine concentration at said inlet port to said reactor; and means for providing an adjustment signal to be fed back to said system for increasing or decreasing the concentration of arsine to said inlet of said reactor.

10. A system as set forth in claim 9 further including a regeneration system for providing fresh arsenic ions to said electrolyte solution.

* * * * *